US010973724B2

(12) United States Patent
Cox et al.

(10) Patent No.: US 10,973,724 B2
(45) Date of Patent: Apr. 13, 2021

(54) COMPACT HINGED CASKET HANDLE

(71) Applicant: Vandor Corporation, Richmond, IN (US)

(72) Inventors: Gary L. Cox, Richmond, IN (US); Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 27 days.

(21) Appl. No.: 15/969,460

(22) Filed: May 2, 2018

(65) Prior Publication Data

US 2019/0336376 A1 Nov. 7, 2019

(51) Int. Cl.
*A61G 17/04* (2006.01)
*A61G 17/02* (2006.01)

(52) U.S. Cl.
CPC ..... *A61G 17/041* (2016.11); *A61G 17/02* (2013.01); *A61G 17/0405* (2017.05)

(58) Field of Classification Search
CPC .. A61G 17/041; A61G 17/0405; A61G 17/02; A61G 17/04; A61G 17/0073; A61G 17/0106; A61G 17/004; Y10T 16/4701; Y10T 16/501; A47B 95/02
USPC ..... 27/27, 4, 14, 17, 2; 16/439, 424
See application file for complete search history.

(56) References Cited

U.S. PATENT DOCUMENTS 1,851,225 A * 3/1932 Wesemann ..... A47B 95/02 16/439
2,033,445 A * 3/1936 Pahlow ..... A47B 95/02 16/439
2,618,835 A * 11/1952 Christian ..... A61G 17/00 27/4
3,698,037 A * 10/1972 Johnson ..... A47B 95/02 16/439
3,823,447 A 7/1974 Johnson
4,615,085 A * 10/1986 Hartman ..... A61G 17/04 16/439
5,561,892 A * 10/1996 Biondo ..... A61G 17/04 16/439
5,689,869 A 11/1997 Linville et al.
5,771,550 A * 6/1998 Laphan ..... A61G 17/00 27/19
5,898,980 A 5/1999 Havranek et al.
5,945,053 A 8/1999 Hettinga
(Continued)

*Primary Examiner* — William L Miller
(74) *Attorney, Agent, or Firm* — Maginot, Moore & Beck LLP

(57) ABSTRACT

A casket includes two side panel structures, two end panels, and a bottom panel. Each end panel is operably coupled to both of the side panel structures. The bottom panel, the two side panel structures and two end panels form, at least in part, a casket container configured to receive adult human remains. Each side panel structure includes a fixed member and a movable member. Each movable member is coupled to one of the fixed members such that each movable member is rotatable relative to the fixed members between a first position and a second position. When each of the movable members is in the first position, the outer surfaces of the movable member and the fixed member are substantially coplanar. When each of the movable members is in the second position, the outer surfaces of the movable member and fixed member are not substantially coplanar.

20 Claims, 8 Drawing Sheets

(56) References Cited

U.S. PATENT DOCUMENTS

| | | | | |
|---|---|---|---|---|
| 6,499,193 | B1 * | 12/2002 | Robert | A61G 17/04 16/424 |
| 6,571,440 | B1 * | 6/2003 | Faulkner | A61G 17/00 27/4 |
| 8,079,119 | B1 * | 12/2011 | Ferko, III | A61G 17/0073 229/155 |
| 8,104,151 | B2 * | 1/2012 | Cox | A61G 17/00 27/4 |
| 2006/0185133 | A1 * | 8/2006 | Beaulne | A61G 17/00 27/4 |
| 2007/0000091 | A1 | 1/2007 | Priegelmeir et al. | |

* cited by examiner

COMPACT HINGED CASKET HANDLE

BACKGROUND

Caskets are a standard part of many traditional memorial and funeral services and ceremonies. Over time, the range of materials and styles that are available for caskets has increased. Now more than ever, friends and families are able to choose a casket for their loved one that fulfills their aesthetic wishes, meets their budgetary limitations, and/or fits their functional needs. Another option that is increasingly available for caskets is a larger size. Larger sized caskets include a larger interior width than a standard casket to accommodate a greater variety of body shapes and sizes. A larger sized casket also enables accommodation of a larger sized person within the casket while maintaining a dignified and restful appearance. However, larger caskets are typically more expensive, due in part to additional materials costs, and also due in part to the fact that they are a non-standard size, and therefore a specialty item. It is desirable to provide a casket with a larger interior width than a standard casket that is also less expensive than a specialty sized casket and further also has a distinguished and respectable appearance.

Another issue with larger caskets is that they may not be compatible with other equipment and spaces used in memorial and funeral services and ceremonies. In particular, larger caskets may be too wide for equipment and spaces that were made to accommodate standard sized caskets. Handles for lifting and transporting the casket are typically formed on the outside walls of the casket. Accordingly, handles add further width to the casket, exacerbating the incompatibility issue of larger caskets. Put another way, handles take up some amount of the overall width of a casket. The farther the handles protrude from the outside walls of the casket, the more of the width of the casket they occupy, which leaves less width in the interior of the casket to accommodate the deceased. It is desirable to provide handles for a casket that maximize the width available in the interior of the casket.

SUMMARY

A casket has been developed including a compact swinging casket handle. The casket includes two side panel structures, two end panels, and a bottom panel. Each end panel is operably coupled to both of the side panel structures. The bottom panel is coupled to both of the side panel structures and both of the end panels such that the bottom panel, two side panel structures and two end panels form, at least in part, a casket container configured to receive adult human remains. Each side panel structure includes a fixed member and a movable member. The fixed member has a fixed member outward surface. Each movable member is coupled to one of the fixed members such that each movable member is rotatable relative to the fixed members between a first position and a second position. Each movable member also has a movable member outward surface. When each of the movable members is in the first position, the movable member outward surface is substantially coplanar with the fixed member outward surface of the fixed member to which the movable member is coupled. When each of the movable members is in the second position, the movable member outward surface is not substantially coplanar with the fixed member outward surface of the fixed member to which the movable member is coupled.

A method of forming a casket including a compact swinging casket handle has been developed. The method includes coupling two side panel structures to a bottom panel and coupling two end panels to the bottom panel to form, at least in part, a casket container configured to receive adult human remains. Each side panel structure includes a fixed member having a fixed member outward surface. The method also includes coupling at least one movable member to each of the fixed members such that each of the movable members is angularly rotatable relative to the fixed members between a first position and a second position. Each of the movable members is coupled to one of the fixed members such that, when each of the movable members is in the first position, a movable member outward surface is substantially coplanar with the fixed member outward surface of the fixed member to which the movable member is coupled. Each of the movable members is coupled to one of the fixed members such that, when each of the movable members is in the second position, the movable member outward surface is not substantially coplanar with the fixed member outward surface of the fixed member to which the movable member is coupled.

The above described features and advantages, as well as others, will become more readily apparent to those of ordinary skill in the art by reference to the following detailed description and accompanying drawings. While it would be desirable to provide a casket and method that provide one or more of these or other advantages, the teachings disclosed herein extend to those embodiments which fall within the scope of the appended claims, regardless of whether they accomplish one or more of the above-mentioned advantages.

DETAILED DESCRIPTION

Figure 4:
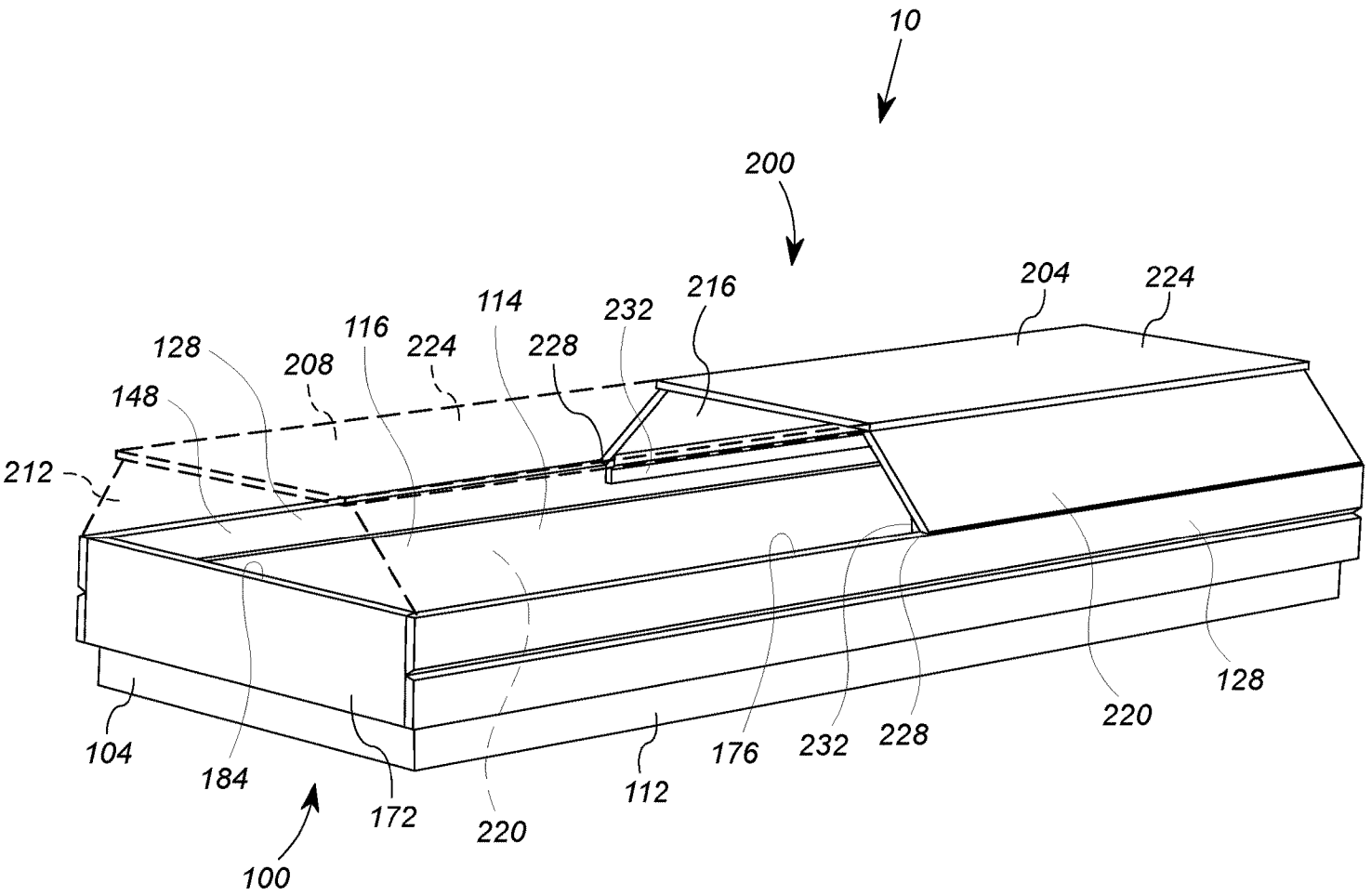
FIG. 4 depicts a front perspective view of a casket including the casket base shown in FIG. 1 and a lid.

FIG. 4 shows a first exemplary embodiment of a casket 10 according to the invention. The casket 10 includes a casket base 100 and a lid 200. The casket base 100 is generally shaped as an open-top box having a length and width configured to receive a deceased adult human body, not shown. The casket base 100 and lid 200 have a height configured to enclose the deceased adult human body.

Figure 1:
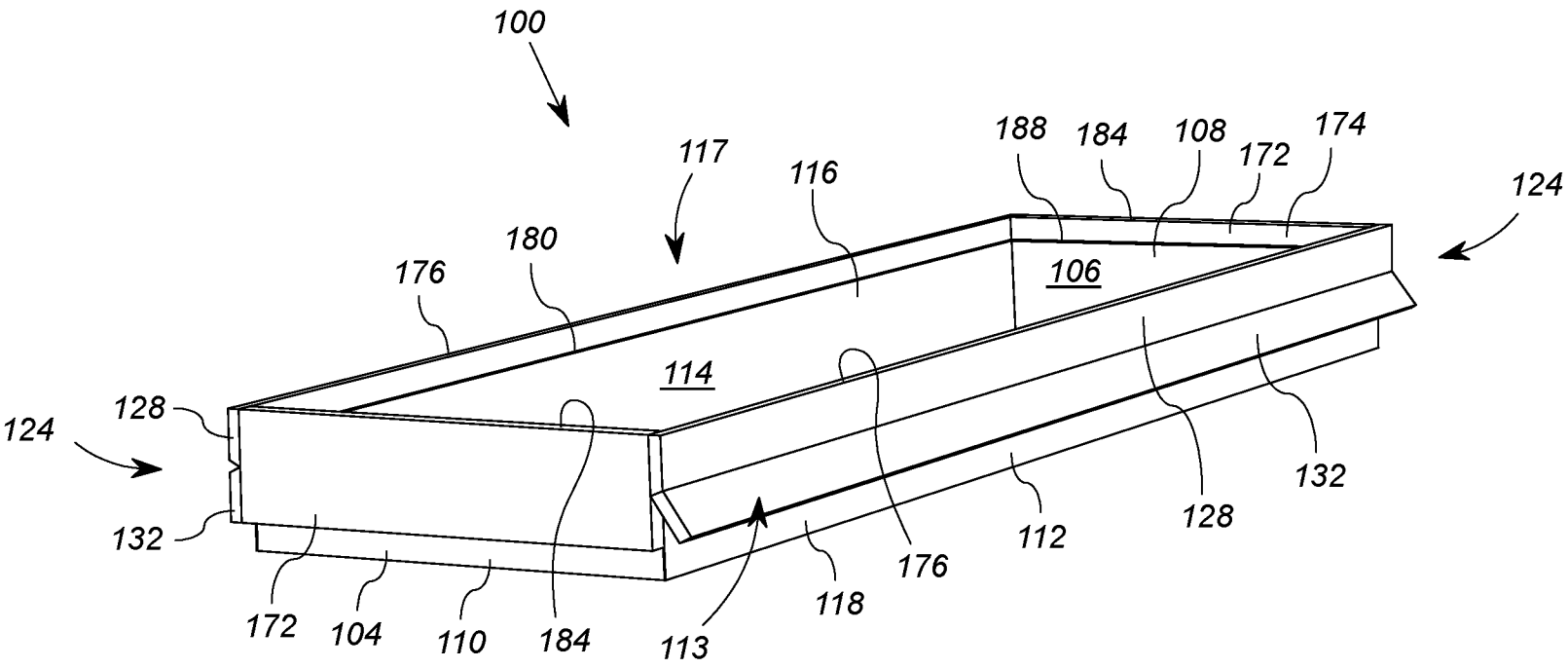
FIG. 1 depicts a front perspective view of one embodiment of a casket base having a compact swinging casket handle.
Figure 2:
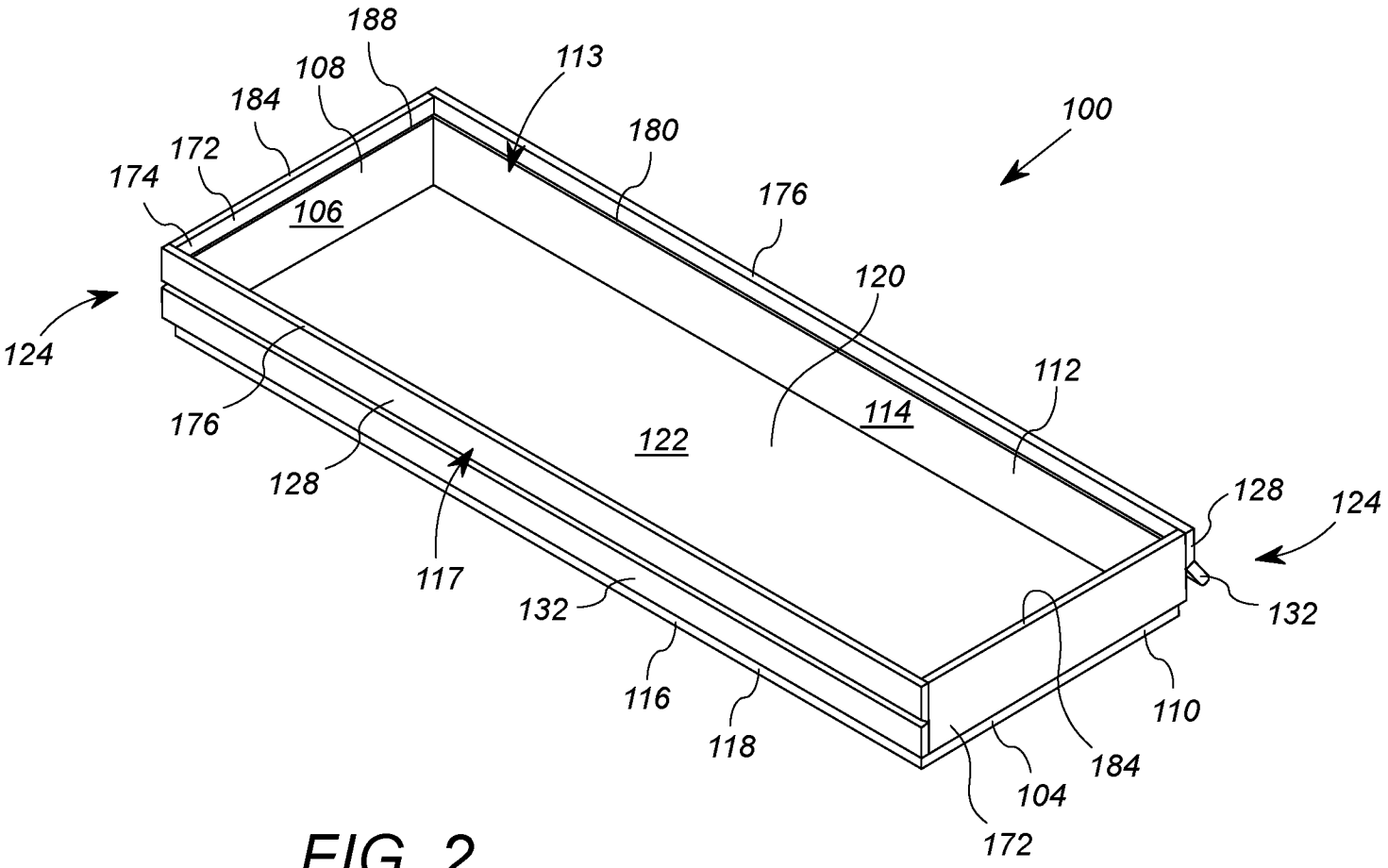
FIG. 2 depicts a top perspective view of the embodiment of the casket base shown in FIG. 1.

With reference to FIGS. 1 and 2, the casket base has two end panels 104, 108 arranged opposite to one another, two inner side panels 112, 116 arranged opposite to one another, and a bottom panel 120 (shown in FIG. 2) coupled to each of the end panels 104, 108 and each of the inner side panels 112, 116. The casket base 100 further includes two handle mechanisms 124, one of which is fixedly coupled to each of the inner side panels 112, 116. As described in further detail below, each handle mechanism 124 includes a fixed member 128, a movable member 132, and a hinge member 136 (shown in FIG. 3). Each of the handle mechanisms 124 is configured such that the fixed member 128 is fixedly coupled to one of the inner side panels 112, 116 and the movable member 132 is angularly rotatable relative to the fixed member 128 via the hinge member 136 to provide a compact swinging casket handle for gripping and manually transporting the casket base 100. The movable members 132 are rotatable between a first position (see handle mechanism 124 on inner side panel 116 on the left in FIG. 1) in which the movable member 132 is "resting" or "neutral," and a second position (see handle mechanism 124 on inner side panel 112 on the right in FIG. 1) in which the movable member 132 is "active" or "angled."

In this embodiment, each fixed member 128 cooperates with the inner side panel 112, 116 to which it is coupled to form a corresponding, reinforced side panel structure 113, 117. Each fixed member 128 in this embodiment is a rigid unitary structure (e.g. a continuous plank or other structure of a single composition), which may be constructed of wood, a wood product, or other materials, and extends between and to each of the end panels 104, 108, thus providing structural reinforcement. To this end, each fixed member 128 is rigidly coupled to each of the end panels 104, 108. In some embodiments, as will be discussed below, the fixed member 128 may constitute the bulk of the side panel structure, wherein the inner side panels 112, 116 do not form full sides of the casket 100, and may even be replaced by plastic liner or elongate plate in some cases.

Referring again to the exemplary embodiment of FIG. 1, the handle mechanisms 124 are configured to protrude as little as possible from the inner side panels 112, 116 of the casket base 100. Accordingly, these low profile handle mechanisms 124 take up little of an overall width of the casket base 100. In other words, the handle mechanisms 124 enable more of the width of a casket base 100 to be available for accommodating the deceased. This is advantageous for both standard and larger sized caskets. For standard sized caskets, the availability of more of the interior width to accommodate the deceased (i.e. deceased adult human) decreases the likelihood of needing a larger sized casket. For larger sized caskets, the additional interior width provides further space for accommodation and presentation of the deceased.

To form the casket base 100, each of the end panels 104, 108 is fixedly coupled to each of the inner side panels 112, 116 and to the bottom panel 120 such that each of the end panels 104, 108 is arranged parallel to one another, perpendicular to the inner side panels 112, 116, and perpendicular to the bottom panel 120. Similarly, each of the inner side panels 112, 116 is fixedly coupled to each of the end panels 104, 108 and to the bottom panel 120 such that each of the inner side panels 112, 116 is arranged parallel to one another, perpendicular to the end panels 104, 108, and perpendicular to the bottom panel 120. The end panels 104, 108 can be fixedly coupled to the inner side panels 112, 116 and to the bottom panel 120 by an adhesive or by a rigid fixation body, such as a screw or nail, or by another known mechanism for irremovably coupling two rigid bodies to one another. Similarly, the inner side panels 112, 116 can be fixedly coupled to the end panels 104, 108 and to the bottom panel 120 by an adhesive or by a rigid fixation body, such as a screw or nail, or by another known mechanism for irremovably coupling two rigid bodies to one another.

Each of the end panels 104, 108 has an end panel inward surface 106 facing toward the opposite end panel 104, 108. Similarly, each of the inner side panels 112, 116 has a side panel inward surface 114 facing toward the opposite inner side panel 112, 116. Additionally, the bottom panel 120 has a bottom panel inward surface 122 (shown in FIG. 2) facing toward the area that is between the end panels 104, 108 and the inner side panels 112, 116. Each of the end panels 104, 108 also has an end panel outward surface 110 facing away from the opposite end panel 104, 108. Similarly, each of the inner side panels 112, 116 has a side panel outward surface 118 facing away from the opposite inner side panel 112, 116. Accordingly, the end panel inward surface 106 of each of the end panels 104, 108 is diametrically opposite the end panel outward surface 110 of the same end panel 104, 108. Similarly, the side panel inward surface 114 of each of the inner side panels 112, 116 is diametrically opposite the side panel outward surface 118 of the same inner side panel 112, 116.

Each of the end panels 104, 108, the inner side panels 112, 116, and the bottom panel 120 is made of a strong, but lightweight material, such as, for example, wood or corrugated paper. An advantage of using materials such as wood and corrugated cardboard for the end panels 104, 108, inner side panels 112, 116, and bottom panel 120 is that the materials are inexpensive and combustible. This facilitates making the casket base 100 as inexpensive as possible and enables the casket base 100 to be cremated, if desired.

Figure 3:
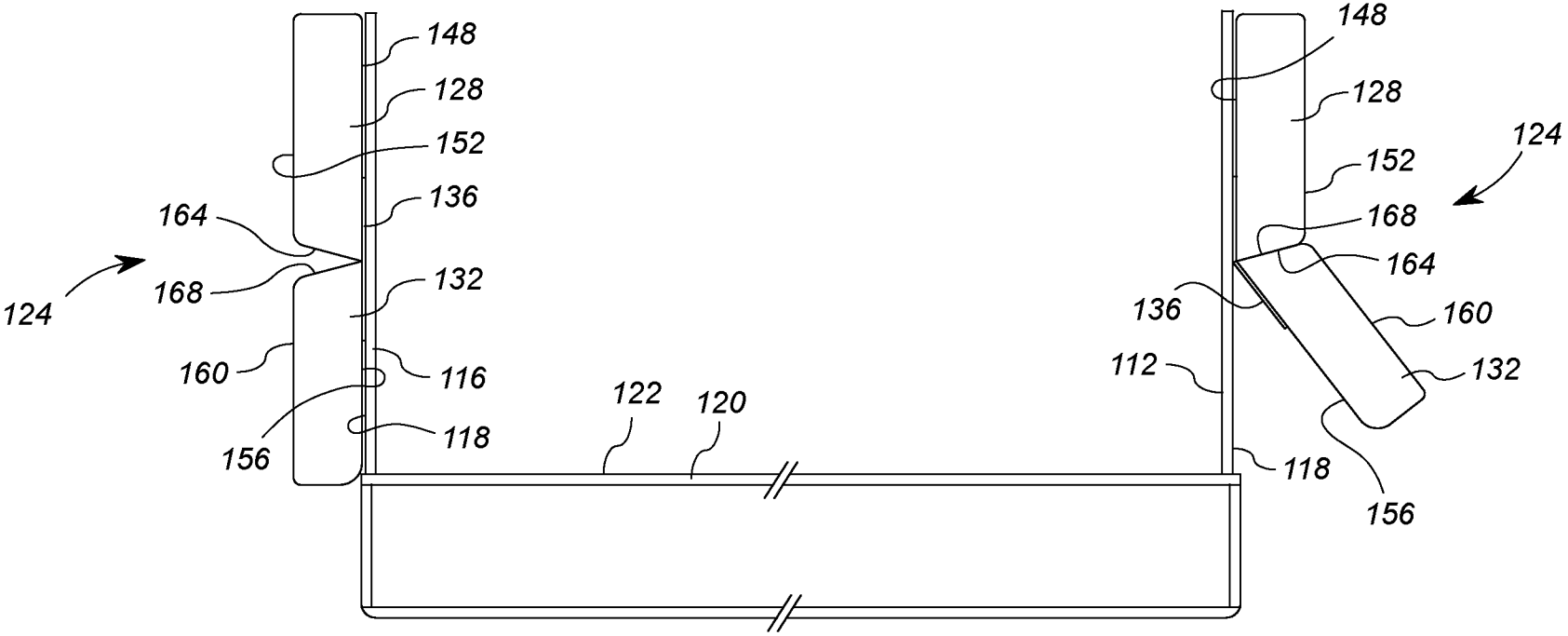
FIG. 3 depicts a partial cross-sectional view of the embodiment of the casket base shown in FIG. 1.

As shown in FIG. 3, each of the handle mechanisms 124 is coupled to the side panel outward surface 118 of one of the inner side panels 112, 116. More specifically, the fixed member 128 of each of the handle mechanisms 124 includes a fixed member casket facing (inward) surface 148, which is directly and fixedly coupled to the side panel outward surface 118 of one of the inner side panels 112, 116. When the fixed member 128 is coupled to the inner side panel 112 or 116, the fixed member 128 is arranged approximately parallel to the inner side panels 112, 116. Each of the fixed members 128 also includes a fixed member outward surface 152, which is diametrically opposite the fixed member casket facing surface 148. Similarly, the movable member 132 of each of the handle mechanisms 124 includes a movable member casket facing (inward) surface 156, which is configured to face toward the side panel outward surface 118 of one of the inner side panels 112, 116 when the movable member is in the first position (as shown on inner side panel 116 on the left in FIG. 3). Each of the movable members 132 also includes a movable member outward surface 160, which is diametrically opposite the movable member casket facing surface 156.

In this embodiment, the fixed members 128 and movable members 132 of the handle mechanisms 124 are made of a strong, rigid material, such as, for example, wood or a wood-like composite product. Each fixed member 128 and its corresponding movable member 132 can be formed from the same piece of wood (or similar material), not shown. The piece of wood, or elongate blanks, is cut to form the shapes of the fixed member 128 and movable member described further below.

The casket facing surface 148 of the fixed member 128 of each of the handle mechanisms 124 is hingedly coupled to the casket facing surface 156 of the movable member 132 via at least one hinge member 136. As shown in FIG. 3, at least one hinge member 136 is coupled to a portion of the casket facing surface 148 of the fixed member 128 and to a portion of the casket facing surface 156 of the movable member 132 to form the hinge connection between the fixed member 128 and the movable member 132. In particular, the at least one hinge member 136 is directly coupled to the casket facing surface 148 of the fixed member 128 and is directly coupled to the casket facing surface 156 of the movable member 132. Thus, the at least one hinge member 136 is at least partially interposed between the casket facing surface 148 of the fixed member 128 and the inner side panel outward surface 118 of the inner side panel 112, 116 to which the handle mechanism 124 is coupled. Similarly, the at least one hinge member 136 is also at least partially interposed between the casket facing surface 156 of the movable member 132 and the inner side panel outward surface 118.

The arrangement of the at least one hinge member 136 between the handle mechanism 124 and the inner side panel 112, 116 enables the movable member 132 to rotate outwardly relative to the fixed member 128, away from the inner side panel outward surface 118. This facilitates gripping the movable member 132 to lift and transport the casket base 100. Furthermore, the arrangement of the at least one hinge member 136 between the handle mechanism 124 and the inner side panel 112, 116 enables a smooth, continuous outward appearance of the casket base 100 when the handle mechanisms 124 are not in use. This is desirable for providing a distinguished and respectable aesthetic for the casket base 100. Moreover, this provides a sleek and modern aesthetic, which many find to be desirable.

The hinge members 136 are flexible members made of, for example, a woven fabric material. The hinge members 136 are also formed of a durable and strong material, for example, a nylon material. The material must be strong enough to support the weight of the deceased during lifting and transporting the deceased inside the casket base 100. However, the material should be lightweight so as not to add unnecessary weight to the casket base 100. Moreover, the material and dimensions of the hinge members must be capable of distributing the load along the fixed members 128 and movable members 132 to avoid failure of the material at a particular load bearing location during lifting and transporting the deceased inside the casket base 100. To this end, multiple woven fabric hinge members having a width of more than one inch may be employed (See analogous hinge members 136" of FIG. 7).

It will be appreciated that at least some advantages of this embodiment may be achieved also with non-woven fabric hinge members.

The hinge members 136 are fixedly coupled to the casket facing surface 148 of the fixed member 128 and the casket facing surface 156 of the movable member 132 by, for example, an adhesive or by rigid fixation bodies, such as rivets or brads, or by another known mechanism for irremovably coupling a flexible body to a rigid body. The mechanism of fixation of the hinge members 136 to the fixed member 128 and the movable member 132 is as low profile as possible to avoid adding more width to the casket base 100.

Each handle mechanism 124 of the casket base 100 is independently operable. In other words, the movable members 132 of the two handle mechanisms 124 can be moved independently of one another between the first position and the second position. The first position of the handle mechanisms 124 is illustrated on the side wall 116 on the left side of FIG. 3. As shown, the handle mechanisms 124 are arranged and configured such that when the movable member 132 is in the first position, the casket facing surface 156 of that movable member 132 is approximately coplanar with the casket facing surface 148 of the fixed member 128 of the same handle mechanism 124.

The term "coplanar," as used herein, means arranged in substantially the same plane. As shown on the left side of FIG. 3, the casket facing surface 156 of the movable member 132 is made up of points arranged in a geometric plane that is perpendicular to the page and is arranged vertically in the arrangement of the casket base 100 shown in FIG. 3. The casket facing surface 148 of the fixed member 128 is also made up of points arranged in a geometric plane that is perpendicular to the page and is arranged vertically in the arrangement of the casket base 100 shown in FIG. 3. When the movable member 132 is arranged in the first position, the points that make up the casket facing surface 156 of the movable member 132 and the points that make up the casket facing surface 148 of the fixed member 128 are arranged in the same geometric plane. Thus, the casket facing surface 156 of the movable member 132 and the casket facing surface 148 of the fixed member 128 are coplanar. The term "approximately," or "substantially" as used herein, accounts for discrepancies resulting from tolerances in manufacturing processes and material properties.

The second position of the handle mechanisms 124 is illustrated on the side wall 112 on the right side of FIG. 3. As shown, the handle mechanisms 124 are arranged and configured such that when the movable member 132 is in the second position, the casket facing surface 156 of that movable member 132 is not approximately coplanar with the casket facing surface 148 of the fixed member 128 of the same handle mechanism 124. In other words, when the movable member 132 is in the second position, the points that make up the casket facing surface 156 of the movable member 132 are arranged in a different geometric plane than the points that make up the casket facing surface 148 of the fixed member 128. In particular, the geometric plane including the points that make up the casket facing surface 156 of the movable member 132 are arranged in a geometric plane that is perpendicular to the page and is arranged at an angle of approximately 34 degrees from vertical. In contrast, the geometric plane including the points that make up the casket facing surface 148 of the fixed member 128 are arranged in a geometric plane that is perpendicular to the page and is arranged vertically in the arrangement of the casket base 100 shown in FIG. 3.

Additionally, as shown in FIG. 3, when the movable member 132 is in the first position, the outward surface 160 of that movable member 132 is approximately coplanar with the outward surface 152 of the fixed member 128 to which that movable member 132 is attached. When the movable member 132 is in the second position, the outward surface 160 of that movable member 132 is not approximately coplanar with the outward surface 152 of the fixed member 128 to which that movable member 132 is attached.

As explained in further detail below, each of the fixed members 128 includes a fixed member stop surface 164 configured to limit the angular rotation of the movable member 132 coupled to that fixed member 128. Additionally, each of the movable members 132 includes a movable member stop surface 168 configured to directly contact and cooperate with the fixed member stop surface 164 to limit the angular rotation of the movable member 132 relative to that fixed member 128, thereby defining the second position. To this end, the stop surfaces 164 and 168 may suitably be beveled edges of, respectively, the fixed members 128 and the movable members 132. However, it will be appreciated that in other embodiments, only one of the stop surfaces 164, 168 need be a beveled or angled edge surface.

With regard to the embodiment of FIGS. 1 and 2, the fixed member stop surface 164 and the movable member stop surface 168 are thus configured delimit the angle of the movable member 132 relative to the fixed member 128 when the movable member 132 is in the second position. For example, the fixed member stop surface 164 and the movable member stop surface 168 are configured to delimit the angle of the movable member 132 relative to the fixed member 128 to an angle of 34 degrees. Alternatively, the fixed member stop surface 164 and the movable member stop surface 168 can delimit the angle of the movable member 132 relative to the fixed member 128 to an angle other than 34 degrees that is large enough to facilitate comfortably gripping the movable member 132 of the handle mechanism 124 and also positions the weight bearing locus of the handle mechanisms 124 in a mechanically stable and robust location.

With specific reference to the beveled stop surfaces, the fixed member stop surface 164 extends between the casket facing surface 148 and the outward surface 152 of the fixed member 128. When the fixed member 128 is coupled to the outward surface 118 of one of the inner side panels 112, 116, the fixed member stop surface 164 is arranged such that it faces in a substantially downwardly direction, generally toward the bottom panel 120. The fixed member stop surface 164 is not arranged perpendicularly to the casket facing surface 148 or the outward surface 152 of the fixed member 128. Instead, it is angled upwardly from the casket facing surface 148 to the outward surface 152. In other words, the fixed member stop surface 164 is angled such that it is nearer to the bottom panel 120 where it meets the casket facing surface 148 and is farther from the bottom panel 120 where it meets the outward surface 152 of the fixed member 128. It will be appreciated that in an alternative embodiment, the fixed member stop surface 164 may only extend partially inward from the outer surface 152.

Similarly, the movable member stop surface 168 extends between the casket facing surface 156 and the outward surface 160 of the movable member 132. When the movable member 132 is coupled to the outward surface 118 of one of the inner side panels 112, 116 via the corresponding fixed member 128 and is in the first position, the movable member stop surface 168 is arranged such that it faces in a substantially upwardly direction, generally toward the fixed member stop surface 164 of the corresponding fixed member 128. In other words, like the fixed member stop surface 164, the movable member stop surface 168 is not arranged perpendicularly to the casket facing surface 156 or the outward surface 160 of the movable member 132. Instead, the movable member stop surface 168 is angled downwardly from the casket facing surface 156 to the outward surface 160. In other words, the movable member stop surface 168 is angled such that, when the movable member 132 is in the first position, the surface 168 is farther from the bottom panel 120 where it meets the casket facing surface 156 and is nearer to the bottom panel 120 where it meets the outward surface 160 of the movable member 132. It will be appreciated that in an alternative embodiment, the movable member stop surface 168 may only extend partially inward from the outward surface 160.

However, when the movable member 132 is moved out of the first position, the movable member stop surface 168 rotates angularly along with the movable member 132. Accordingly, the orientation of the movable member stop surface 168 varies as the movable member 132 rotates between the first position and the second position. In the embodiment shown in FIG. 3, the angle of the fixed member stop surface 164 and the angle of the movable member stop surface 168 are configured such that, when the movable member stop surface 168 is in contact with the fixed members stop surface 164, the movable member stop surface 168 is nearer to the bottom panel 120 where it meets the casket facing surface 156 and is farther from the bottom panel 120 where it meets the outward surface 160 of the movable member 132.

In the embodiment shown, each of the handle mechanisms 124 extends along an entire length of the inner side panel 112, 116 from the end panel 104 to the end panel 108. This arrangement provides a continuous and cohesive aesthetic and a uniform dimension along the entire length of the casket base 100. However, in alternative embodiments, each of the handle mechanisms 124 can extend over less than the entire length of the inner side panel 112, 116 and still provide a stable and robust mechanism for carrying the casket base 100.

Additionally, as shown in the embodiment of FIGS. 1 and 2, the casket base 100 further includes two end cover panels 172. Each end cover panel 172 includes a casket facing surface 174 which is directly coupled to the outward surface 110 of a corresponding one of the end panels 104, 108. Each of the end cover panels 172 extends over an entire width of the outward surface 110 of the end panel 104, 108 from the inner side panel 112 to the inner side panel 116. The end cover panels 172 also extend from the handle mechanism 124 coupled to the inner side panel 112 to the handle mechanism 124 coupled to the inner side panel 116. Thus, the end cover panels 172 are configured and arranged to provide a continuous and cohesive aesthetic with the handle mechanisms 124 that extends around the entire perimeter of the outward surfaces 110, 118 of the end panels 104, 108 and the inner side panels 112, 116 of the casket base 100. In alternative embodiments, the casket base 100 may not include end cover panels 172 or may include end cover panels 172 having a different shape or arrangement than that shown in the embodiment of FIGS. 1 and 2.

The cover panels 172 cooperate with the end panels 104, 108 to form reinforced end panel structures, similar to the side panel structures 113, 117. The cover panels 172 provide reinforcement to the end panels 104, 108. In some embodiments, the cover panels 172 connect to the fixed members 128 form a stiff, skeletal structure for the casket base 100.

In the embodiment of the casket base 100 shown in FIGS. 1 and 2, each of the fixed members 128 of the handle mechanisms 124 has a fixed member top surface 176 that is arranged approximately parallel to the bottom panel inward surface 122 and farther from the bottom panel inward surface 122 than is a inner side panel top surface 180 of the inner side panel 112, 116 to which the fixed member 128 is attached. Accordingly, each of the fixed members 128 extends farther from the bottom panel 120 than does the corresponding inner side panel 112, 116. Similarly, each of the end cover panels 172 has a cover panel top surface 184 that is arranged approximately parallel to the bottom panel inward surface 122 and farther from the bottom panel inward surface 122 than is an end panel top surface 188 of the end panel 104, 108 to which the end cover panel 172 is attached. Accordingly, each of the end cover panels 172 extends farther from the bottom panel 120 than does the corresponding end panel 104, 108. The fixed member top surfaces 176 are arranged at the same distance from the bottom panel 120 as the end panel top surfaces 188. Accordingly, the fixed member top surfaces 176 and the end panel top surfaces 188 form a continuous top surface around the perimeter of the casket base 100.

As discussed above, the casket 10 of FIG. 4 includes the casket base 100 as well as the lid 200. The lid 200 in this embodiment is formed in two separate parts 204, 208. Part 208 of the lid 200 is shown in phantom with dashed lines in FIG. 4. Each part 204, 208 of the lid 200 includes an end piece 212, two side pieces 216, 220, and a top piece 224. When both of the lid parts 204, 208 are arranged on the casket base 100, the top pieces 224 of the lid parts 204, 208 cooperate to form a single continuous panel arranged approximately parallel to and spaced apart from the bottom panel 120 of the casket base 100. Additionally, the side pieces 216 of the lid parts 204, 208 cooperate to form a single continuous inner side panel extending from the casket base 100 to the top pieces 224, and the side pieces 220 of the lid parts 204, 208 cooperate to form a single continuous inner side panel extending from the casket base 100 to the top pieces 224.

Each of the side pieces 216, 220 and the end piece 212 of both of the lid parts 204, 208 includes a lip 228 configured to rest on the casket base 100. More specifically, at the side pieces 216, 220, the lip 228 of each of the lid parts 204, 208 is configured to rest on portions of both of the fixed member top surfaces 176, and at the end pieces 212, the lip 228 of each of the end parts 204, 208 is configured to rest on the cover panel top surfaces 184 of one of the end cover panels 172.

Additionally, each of the side pieces 216, 220 and the end piece 212 of both of the lid parts 204, 208 further includes a brace 232 configured to rest inside the casket base 100. More specifically, at the side pieces 216, 220, the brace 232 rests against the casket facing surfaces 148 of the fixed members 128, and at the end pieces 212, the brace 232 rests against the casket facing surfaces 174 (shown in FIGS. 1 and 2) of the end cover panels 172. Together, the lips 228 and the braces 232 of the lid parts 204, 208 secure the lid 200 in place on the casket base 100 to form the casket 10.

In alternative embodiments, the casket 100 may not include end cover panels 172. In such embodiments, the lid parts 204, 208 cooperate with the end panels 104, 108 instead of the end cover panels 172 to secure the lid 200 in place on the casket base 100 to form the casket 10. In further alternative embodiments, the end cover panels 172 and the fixed members 128 may not extend farther from the bottom panel 120 of the casket base 100 than the end panels 104, 108 and inner side panels 112, 116. Instead, the end cover panels 172 and fixed members 128 may be coextensive with the end panels 104, 108 and the inner side panels 112, 116. In such embodiments, the braces 232 of the lid parts 204, 208 rest against the inward surfaces 106 (shown in FIGS. 1 and 2) of the end panels 104, 108 and the inward surfaces 114 of the inner side panels 112, 116 instead of the casket facing surfaces 148 of the fixed members 128 and the casket facing surfaces 174 of the end cover panels 172. In further alternative embodiments, the lid 200 can comprise only one part instead of two separate lid parts 204, 208. In such embodiments, the lid 200 cooperates with both fixed members 128 and both end cover panels 172 to be secured in place on the casket base 100 to form the casket 10.

Figure 5:
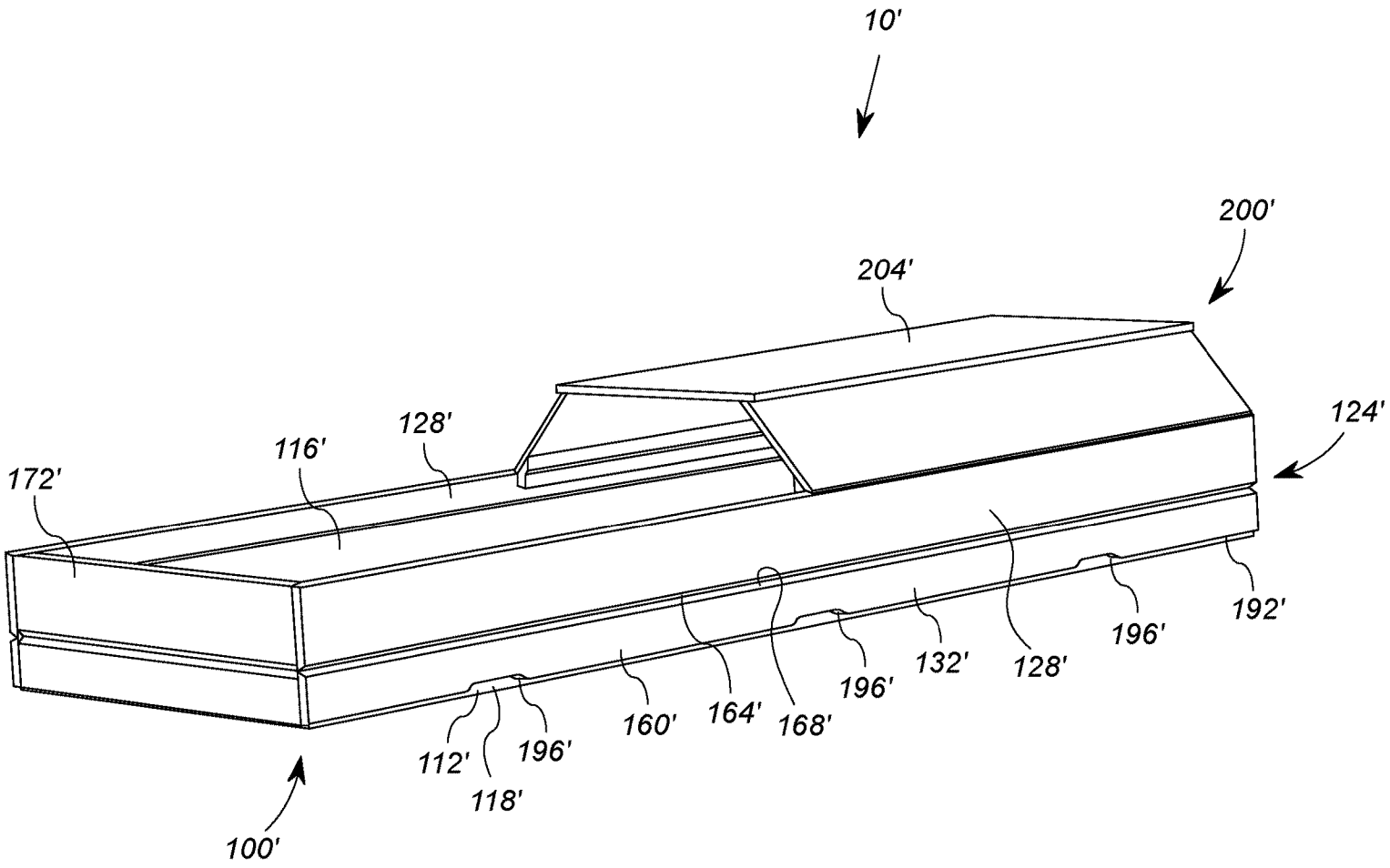
FIG. 5 depicts a front perspective view of an alternative embodiment of a casket including a casket base and a lid.

FIG. 5 depicts an alternative embodiment of a casket 10' including a casket base 100' and a lid 200'. Only one lid part 204' is shown in FIG. 5. The casket 10' is substantially similar in structure and function to the casket 10 shown in FIG. 4 and described above. More specifically, the lid 200' is the same as the lid 200 shown in FIG. 4 and described above, and the casket base 100' is similar to the casket base 100. However, as described in further detail below, the casket base 100' differs from the casket base 100 in that the handle mechanisms 124' are different from the handle mechanisms 124 and the end cover panels 172' differ from the end cover panels 172.

In FIG. 5, both of the movable members 132' are shown in the first position. However, each of the movable members 132' is configured and arranged to move between the first position and the second position as described above with respect to movable members 132. Each of the movable members 132' also includes a movable member bottom surface 192' and at least one notch 196' formed in the movable member bottom surface 192' Like the movable member stop surface 168', the movable member bottom surface 192' extends between the movable member casket facing surface 156' (not shown in FIG. 5) and the movable member outward surface 160'. However, the movable member bottom surface 192' is arranged at the opposite end of the movable member 132' from the movable member stop surface 168'. When each of the movable members 132' is in the first position, as shown in FIG. 5, the movable member bottom surface 192' is approximately parallel to and coplanar with an outward surface (not shown) of the bottom panel 120' (not shown in FIG. 5). The outward surface of the bottom panel 120' is diametrically opposed to the bottom panel inward surface 122' (not shown in FIG. 5).

Each of the notches 196' is formed in the movable member bottom surface 192' extending into the movable member 132' in the direction of the movable member stop surface 168'. Each of the notches 196' is configured to provide a hand hold where users can comfortably and securely grip the movable member 132' to lift and transport the casket 10'. More specifically, when a user grasps one of the notches 196', the movable member 132' freely rotates relative to the fixed member 128' until the movable member stop surface 168' contacts the fixed member stop surface 164' in the second position. The angular rotation of the movable member 132' outwardly away from the inner side panel outward surface 118' enables the user's fingers to fit between the movable member 132' and the inner side panel 112', 116' to comfortably and securely grip the movable member 132' of the handle mechanism 124' to lift and transport the casket 10'. When the user releases the notch 196', the movable member 132' freely rotates back to the first position such that the movable member 132' does not project any farther from the inner side panel 112', 116' than does the fixed member 128' of the same handle mechanism 124'.

As described above, in the embodiment of the casket 10' shown in FIG. 5, the bottom surface 192' of each of the movable members 132' is approximately coplanar with the bottom surface of the bottom panel 120'. Accordingly, to provide aesthetic continuity, each of the end cover panels 172' also includes an end cover panel bottom surface 198', which is approximately parallel to and coplanar with the bottom surface of the bottom panel 120'. Accordingly, each end cover panel bottom surface 198' is also approximately parallel to and coplanar with the movable member bottom surface 192' of each of the movable members 132' when the movable member 132' is in the first position.

Figure 6:
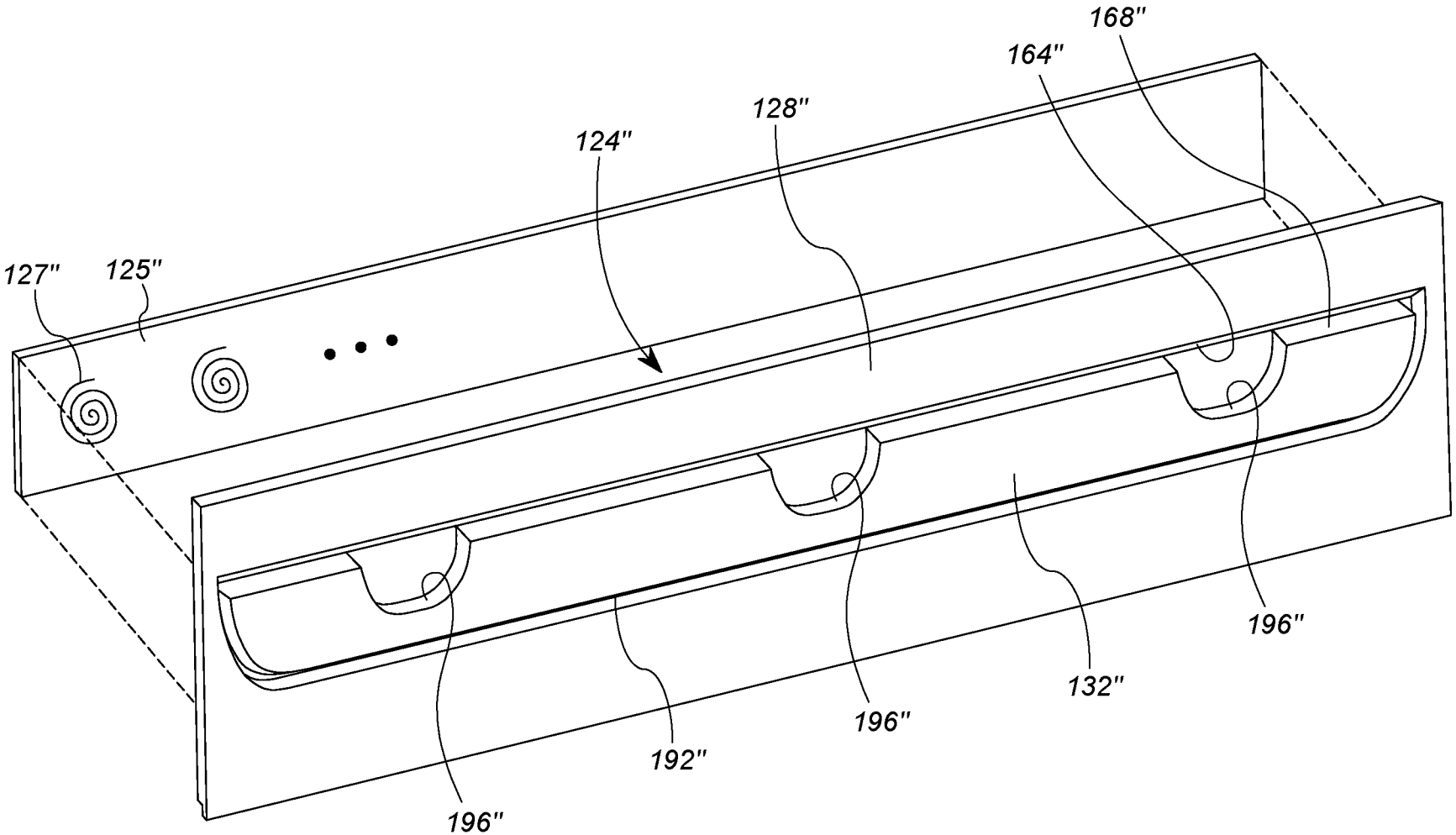
FIG. 6 depicts a front perspective view of an alternative embodiment of a handle mechanism for use with the casket base shown in FIG. 1.
Figure 7:
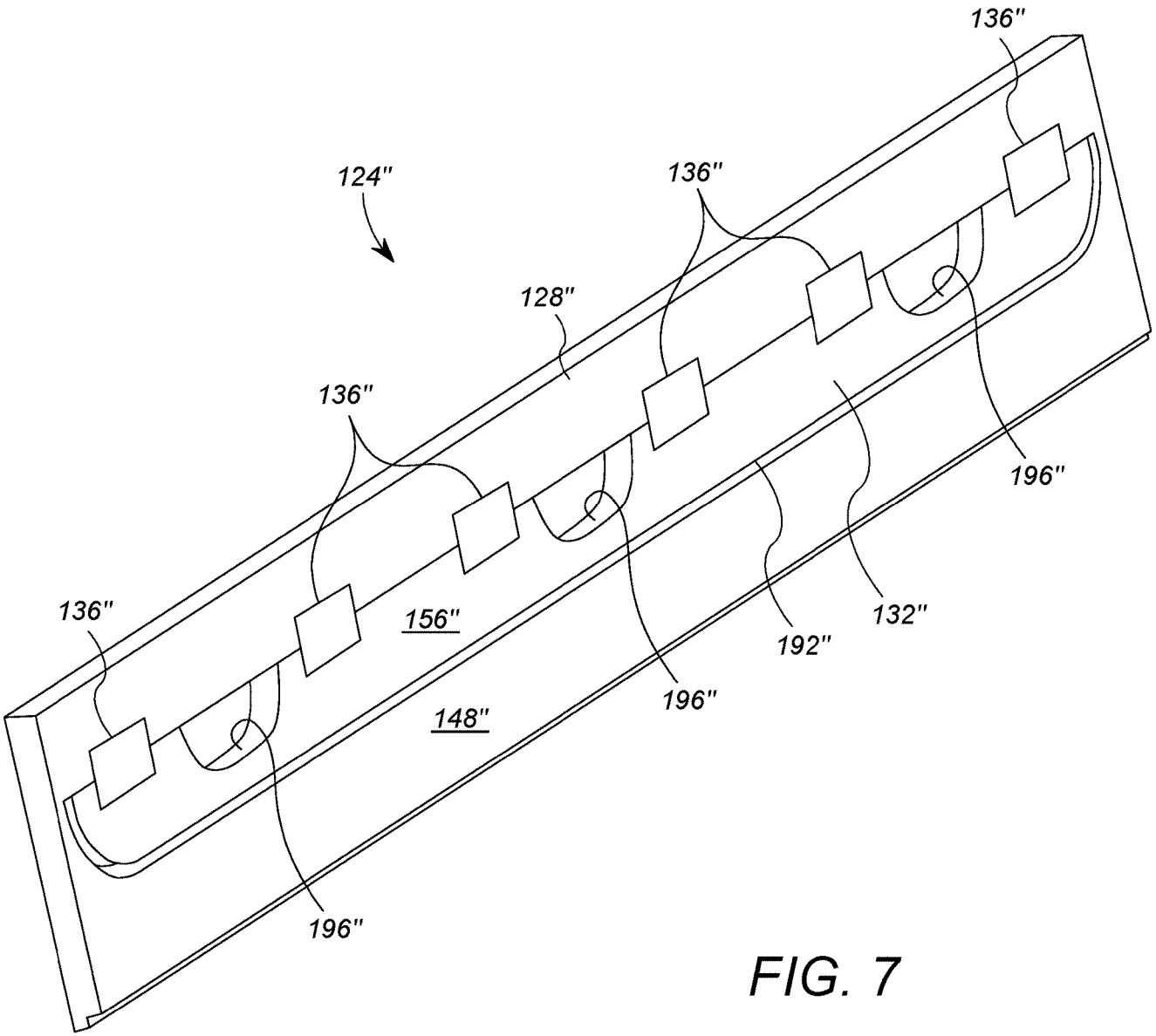
FIG. 7 depicts a back perspective view of the handle mechanism shown in FIG. 6.

FIGS. 6 and 7 depict an alternative embodiment of a handle mechanism 124" that is similar in structure and function to each of the handle mechanisms 124 shown and described with reference to FIGS. 1-4 and each of the handle mechanisms 124' shown and described with reference to FIG. 5. However, as described in further detail below, the handle mechanism 124" differs from the handle mechanisms 124 and 124' in that the handle mechanism 124" includes a fixed member 128" that is arranged both above and below the movable member 132" and that each movable member 132" includes a notch 196" formed in the movable member stop surface 168". As with the embodiments described above, the movable member 132" and the fixed member 128" may be cut from a single blank.

In FIGS. 6 and 7, the movable member 132" of the handle mechanism 124" is shown in the first position. However, the movable member 132" is configured and arranged to move between the first position and the second position in the manner described above with respect to movable members 132. As shown in FIG. 7, to accommodate the notches 196" formed in the movable member top surface 168", the handle mechanism 124" includes a plurality of hinge members 136" that are coupled to the fixed member casket facing surface 148" and the movable member casket facing surface 156" and are spaced along the movable member top surface 168". The plurality of hinge members 136" enable the movable member 132" to rotate relative to the fixed member 128" and provide a sturdy and robust attachment between the fixed member 128 "and the movable member 132".

The notches 196" are formed in the movable member stop surface 168", and extend in the direction of the movable member bottom surface 192". Each of the notches 196" is configured to provide a hand hold where a user can comfortably and securely grip the movable member 132" to lift and transport a casket base, such as casket base 100 (shown in FIG. 1), when the handle mechanism 124" is coupled to the casket base 100. When the handle mechanism 124" is coupled to the casket base 100, the movable member 132" is free to rotate away from the inner side panel outward surface 118 of the inner side panel 112, 116 of the casket base 100.

Accordingly, to grasp the movable member 132", the user reaches the fingers through the notch 196" and between the movable member casket facing surface 156" (shown in FIG. 7) and the inner side panel outward surface 118. This action rotates the movable member bottom surface 192" outwardly and separates the movable member bottom surface 192" from the fixed member outward surface 152" (shown in FIG. 6). Accordingly, the user is then able to wrap the thumb around the movable member bottom surface 192" such that both the fingers and the thumb grasp the movable member casket facing surface 156" while the palm is arranged on the movable member outward surface 160" (shown in FIG. 6).

When a user grasps one of the movable members 132" by reaching the fingers through the notch 196" and wrapping the thumb around the movable member bottom surface 192", the movable member 132" freely rotates relative to the fixed member 128" until the movable member stop surface 168" contacts the fixed member stop surface 164" (shown in FIG. 6) in the second position. It will be appreciated that either or both of the stop surfaces 164" and 168" may have a beveled edge analogous to the stop surfaces 164, 168 of FIG. 3.

When the user releases the movable member 132", the movable member 132" freely rotates back to the first position such that the movable member 132" does not project any farther from the inner side panel 112, 116 than does the fixed member 128" of the same handle mechanism 124".

Figure 8:
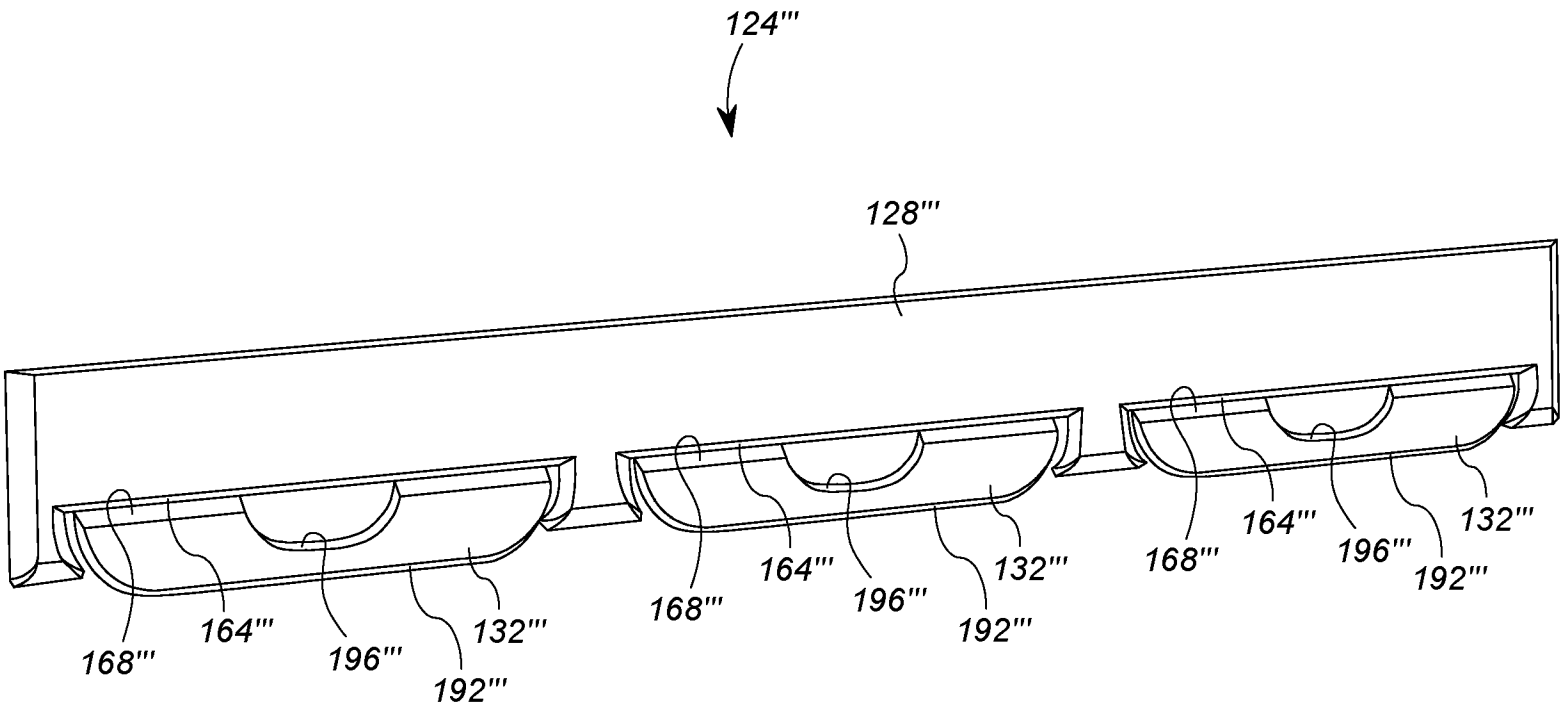
FIG. 8 depicts a front perspective view of another alternative embodiment of a handle mechanism for use with the casket base shown in FIG. 1.

FIG. 8 depicts an alternative embodiment of a handle mechanism 124'" that is similar in structure and function to each of the handle mechanisms 124 shown and described with reference to FIGS. 1-4, each of the handle mechanisms 124' shown and described with reference to FIG. 5, and handle mechanism 124" shown and described with reference to FIGS. 6 and 7. However, as described in further detail below, the handle mechanism 124'" differs from the handle mechanisms 124, 124', and 124" in that the handle mechanism 124'" includes a plurality of independently movable members 132'" rotatably coupled to the fixed member 128'" and that each movable member 132'" includes a notch 196'" formed in the movable member stop surface 168'".

In FIG. 8, each of the movable members 132'" of the handle mechanism 124'" is shown in the first position. However, each of the movable members 132'" is independently configured and arranged to move between the first position and the second position in the manner described above with respect to movable members 132. Accordingly, each of the movable members 132'" is independently coupled to the fixed member 128'" by corresponding hinge members. (The hinge members of the handle mechanism 124'" are not shown in FIG. 8, but are substantially similar to hinge members 136" shown in FIG. 7.)

Each movable member 132'" also includes a movable member bottom surface 192'" and a notch 196". Each notch 196'" is formed in one of the movable member stop surfaces 168'" in the direction of the movable member bottom surface 192". Each of the notches 196'" is configured to provide a hand hold where a user can comfortably and securely grip the movable member 132'" by reaching the fingers through the notch 196'" and wrapping the thumb around the movable member bottom surface 192'". When a user grasps one of the movable members 132'" by reaching the fingers through the notch 196'" and wrapping the thumb around the movable member bottom surface 192'", the movable member 132'" freely rotates relative to the fixed member 128'" until the movable member stop surface 168'" contacts the fixed member stop surface 164'" in the second position.

When the handle mechanism 124'" is coupled to a casket base, such as casket base 100 (shown in FIG. 1), the angular rotation of the movable member 132'" outwardly away from the inner side panel outward surface 118 enables the user's fingers and thumb to fit between the movable member 132'" and the inner side panel 112, 116 to comfortably and securely grip the movable member 132'" of the handle mechanism 124'" to lift and transport the casket base 100. When the user releases the movable member 132'", the movable member 132'" freely rotates back to the first position such that the movable member 132'" does not project any farther from the inner side panel 112, 116 than does the fixed member 128'" of the same handle mechanism 124'".

In at least one embodiment, the handle mechanism 124'" can be fixedly coupled to a casket base 100 such that the movable member bottom surfaces 192'" are approximately parallel to and coplanar with the bottom panel bottom surface (not shown) when each of the movable members 132'" is in the first position. In alternative embodiments, the handle mechanism 124'" can be fixedly coupled to a casket base 100 such that the movable member bottom surfaces 192'" are approximately parallel to, but not coplanar with, the bottom panel bottom surface when each of the movable members 132'" is in the first position.

In the embodiments of FIGS. 6-8, similar to the embodiment of FIGS. 1 and 2, the fixed members 128" and 128'" can form essentially the entire side panel structure. Instead of as inner side panel 112, 116, as shown in FIG. 1, material (i.e. a sheet or strip of plastic, wood, paper, etc.) may be employed that merely covers the openings in the fixed members 128" and 128'", including areas nominally covered by the movable members 132" and 132'" in the first position. For example, FIG. 6 shows an exemplary strip 125" that may be placed behind the fixed member 128" such that it covers the opening in the fixed member 128" wherein the movable member 132" is located. As shown in FIG. 6, the strip 125" may have aesthetic decorations 127", which may be standardized, or selected from a plurality of available designs. The strip 125" is shown separated from the fixed member 128" for clarity of exposition.

In an embodiment where the strip 125" is customizable, the strip 125" is configured for easy assembly at the funerary establishment. For example, the strip 125" may contain adhesive on that affixes to the inward facing surface of the fixed member 128" (or fixed member 128'''. Alternatively, the strip 125" may be affixed to the same surface using other means, such as hook and loop fasteners or staples.

Caskets, such as casket 10 and casket 10', and similar caskets including casket bases, such as casket base 100 and casket base 100', can be made in the following manner. End panels 104, 108 are directly coupled to a bottom panel 120 such that the end panels 104, 108 are parallel to one another and perpendicular to the bottom panel 120. Similarly, inner side panels 112, 116 are directly coupled to the bottom panel 120 such that the inner side panels 112, 116 are parallel to one another and perpendicular to the bottom panel 120. Additionally, inner side panels 112, 116 are directly coupled to the end panels 104, 108 such that the inner side panels 112, 116 are perpendicular to the end panels 104, 108.

Handle mechanisms 124 are coupled to each of the inner side panels 112, 116. In particular, one handle mechanism 124 is coupled to each inner side panel 112, 116. Each handle mechanism 124 includes a fixed member 128, which is directly coupled to the inner side panel 112, 116. More specifically, the fixed member 128 is coupled to the inner side panel 112, 116 such that a casket facing surface 148 of the fixed member 128 is directly coupled to an outward surface 118 of the inner side panel 112, 116. The fixed member 128 is coupled to the inner side panel 112, 116 such that the fixed member 128 is approximately parallel to the inner side panel 112, 116.

A movable member 132 of each handle mechanism 124 is coupled to the fixed member 128 via a hinge member 136 such that the movable member 132 is angularly rotatable relative to the fixed member 128 between a first position and a second position. When the movable member 132 is in the first position, a casket facing surface 156 of the movable member 132 is approximately coplanar with the casket facing surface 148 of the fixed member 128. Furthermore, when the movable member 132 is in the first position, an outward surface 160 of the movable member 132, which is diametrically opposed to the casket facing surface 156 of the movable member 132, is approximately coplanar with an outward surface 152 of the fixed member 128, which is diametrically opposed to the casket facing surface 148 of the fixed member 128.

When the movable member 132 is in the second position, the casket facing surface 156 of the movable member 132 is not approximately coplanar with the casket facing surface 148 of the fixed member 128. Furthermore, when the movable member 132 is in the second position, the outward surface 160 of the movable member 132 is not approximately coplanar with the outward surface 152 of the fixed member 128.

The movable member 132 is coupled to the fixed member 128 by directly coupling the hinge member 136 to the casket facing surface 148 of the fixed member 128 and directly coupling the hinge member 136 to the casket facing surface 156 of the movable member 132. Furthermore, the hinge member 136 is directly coupled to the fixed member 128 and to the movable member 132 such that the hinge member is at least partially interposed between the inner side panel 112, 116 and the fixed member 128.

The fixed member 128 is coupled to the inner side panel 112, 116 such that a fixed member stop surface 164 is arranged to limit angular rotation of the movable member 132. The fixed member 128 may further be coupled to the end panels 104, 108 and/or the end cover panels 172. Furthermore, the movable member 132 is coupled to the fixed member 128 such that a movable member stop surface 168 is arranged to directly contact the fixed member stop surface 164 when the movable member 132 is in the second position.

The foregoing description of one or more embodiments of the casket, casket base, and method of forming a casket has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems, or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A casket, comprising:

two side panel structures and two end panels, each end panel operably coupled to both of the side panel structures;

a bottom panel coupled to both of the side panel structures and both of the end panels such that the bottom panel, the two side panel structures and the two end panels form, at least in part, a casket container configured to receive adult human remains;

wherein each side panel structure includes a fixed member, the fixed member having a fixed member outward surface, and a movable member, each movable member coupled to one of the fixed members such that each movable member is rotatable relative to corresponding one of the fixed members between a first position and a second position, each movable member having a movable member outward surface, wherein, when each of the movable members is in the first position, the movable member outward surface is substantially coplanar with the fixed member outward surface of the fixed member to which the movable member is coupled, wherein, when each of the movable members is in the second position, the movable member outward surface is not substantially coplanar with the fixed member outward surface of the fixed member to which the movable member is coupled; and further comprising at least two hinge members, each hinge member coupling one of the fixed members to one of the movable members, each hinge member is made of a woven fabric material.

2. The casket of claim 1, wherein each side panel structure includes an inner side panel, wherein each fixed member has an inward surface that abuts the inner side panel.

3. The casket of claim 2, wherein:

each of the inner side panels includes a side panel inward surface, which is arranged facing toward the inner side panel of the other of the side panel structures of the casket, and an opposing side panel outward surface, and each of the fixed members abuts the side panel outward surface of a corresponding one of the inner side panels.

4. The casket of claim 1, wherein:

each of the hinge members is directly coupled to one of the fixed members and directly coupled to one of the movable members.

5. The casket of claim 1, wherein:

each fixed member has a fixed member inward surface opposite the fixed member outward surface, each movable member has a movable member inward surface opposite the movable member outward surface, and when each of the movable members is in the first position, the movable member inward surface is substantially coplanar with the fixed member inward surface of the fixed member to which the movable member is coupled.

6. The casket of claim 1, further comprising:

two end cover panels, each end cover panel coupled adjacent to one of the end panels, each end cover panel having an end cover panel top surface that is arranged at a distance from the bottom panel, wherein each of the fixed members has a fixed member top surface that is arranged at the distance from the bottom panel.

7. The casket of claim 6, further comprising:

a lid configured to contact at least one of the end cover panels and at least a portion of each of the fixed members so as to cover at least a portion of an interior dimension formed by the bottom panel, the side panel structures and the end panels.

8. The casket of claim 7, wherein:

the lid is configured to cooperate with the end cover panel top surface of the at least one of the end cover panels and the fixed member top surface of the at least a portion of each of the fixed members so as to be arranged approximately parallel to and spaced apart from the bottom panel.

9. A method of making a casket, the method comprising:

a) coupling two side panel structures to a bottom panel and coupling two end panels to the bottom panel to form, at least in part, a casket container configured to receive adult human remains, wherein each side panel structure includes a fixed member having a fixed member outward surface, each fixed member extending from a first of the two end panels to a second of the two end panels, b) coupling at least one movable member to each of the fixed members such that each of the movable members is angularly rotatable relative to the fixed members between a first position and a second position, wherein each of the movable members is coupled to one of the fixed members such that, when each of the movable members is in the first position, a movable member outward surface is substantially coplanar with the fixed member outward surface of the fixed member to which the movable member is coupled, wherein each of the movable members is coupled to one of the fixed members such that, when each of the movable members is in the second position, the movable member outward surface is not substantially coplanar with the fixed member outward surface of the fixed member to which the movable member is coupled, and wherein at least one of the fixed members includes an integrally formed fixed member stop surface to engage the moveable member in the second position to limit angular rotation of the movable member coupled to the fixed member.

10. The method of claim 9, wherein:

step a) includes coupling a first fixed member to an outward surface of an inner side panel of one of the side panel structures, the outward surface of the inner side panel opposite an inward surface of the inner side panel, the inward surface of the side panel facing an inward surface of an inner side panel of the other side panel structure.

11. The method of claim 9, wherein step b) further comprises coupling a first fixed member to a first of the moveable members using at least one hinge member.

12. The method of claim 9, wherein:

the fixed member stop surface comprises a beveled edge of the fixed member.

13. The method of claim 9, wherein at least one of the movable members includes an integrally formed movable member stop surface to engage the fixed member stop surface in the second position to limit angular rotation of the movable member coupled to the fixed member, and wherein the movable member stop surface comprises a beveled edge.

14. A casket, comprising:

two side panel structures and two end panels, each end panel operably coupled to both of the side panel structures;

a bottom panel coupled to both of the side panel structures and both of the end panels such that the bottom panel, the side panel structures and the two end panels form, at least in part, a casket container configured to receive adult human remains;

wherein each side panel structure includes a fixed member and a movable member, each movable member coupled to one of the fixed members such that each movable member is rotatable relative to the fixed members between a first position and a second position, each movable member having a stop surface, and each fixed member having a stop surface;

wherein, when each of the movable members is in the first position, at least a portion of the movable member is disposed directly below at least a part of the fixed member, and wherein the stop surface of the fixed member engages the stop surface of the moveable member in the second position, and wherein at least one of the stop surface of the movable member and the stop surface of the fixed member comprises a beveled edge.

15. The casket of claim 14, wherein the fixed member is an integrally formed unitary member, and extends between and to each of the two end panels.

16. The casket of claim 15, further comprising:

at least two woven hinge members, each hinge member coupling one of the fixed members to one of the movable members.

17. The casket of claim 16, wherein each hinge member is directly coupled to one of the fixed members and directly coupled to one of the movable members.

18. The casket of claim 14, wherein the stop surface of the movable member has the beveled edge.

19. The casket of claim 14, wherein a first portion of the fixed member extends above the movable member in the first position, and a second portion of the fixed member extends below the movable member in the first position.

20. The casket of claim 19, wherein each movable member further comprises a notch configured to provide a handhold on the movable member.

* * * * *